United States Patent [19]

Dehne

[11] Patent Number: 4,584,944

[45] Date of Patent: Apr. 29, 1986

[54] CONVEYOR SYSTEM WITH AUTOMATIC LOAD TRANSFER

[75] Inventor: Clarence A. Dehne, Farmington Hills, Mich.

[73] Assignee: Jervis B. Webb Company, Farmington Hills, Mich.

[21] Appl. No.: 603,596

[22] Filed: Apr. 25, 1984

[51] Int. Cl.[4] ..... B61B 3/00; B61B 13/00

[52] U.S. Cl. ..... 104/89; 104/172 S

[58] Field of Search ..... 104/172 S, 89

[56] References Cited

U.S. PATENT DOCUMENTS

| | | | |
|---|---|---|---|
| 2,752,883 | 7/1952 | Curtis | 104/89 |
| 2,769,728 | 11/1956 | Jurinall | 104/89 |
| 3,664,267 | 5/1972 | Rosa | 104/172 S |
| 3,683,817 | 8/1972 | Macomber et al. | 104/89 |
| 4,341,161 | 7/1982 | Morita | 104/172 S |

FOREIGN PATENT DOCUMENTS

| | | | |
|---|---|---|---|
| 518644 | 1/1931 | Fed. Rep. of Germany | 104/89 |
| 1083448 | 9/1967 | United Kingdom | 104/89 |

*Primary Examiner*—Ronald H. Lazarus

*Attorney, Agent, or Firm*—Joseph W. Farley

[57] ABSTRACT

A conveyor system in which loads supported by forwardly driven carriers of an overhead power and free conveyor are automatically transferred to a second conveyor arranged below the overhead conveyor at a transfer zone and driven at the same forward speed. The vertical spacing between the overhead and second conveyors is decreased from a greater spacing at which a load is engaged and supported by downwardly extending structure of a carrier to a lesser spacing at which the load is disengaged from the carrier structure and is supported by the second conveyor. As the disengaged carrier and load move forwardly in unison on their respective overhead and second conveyors, the carrier is engaged and moved by a transfer conveyor obliquely to the second conveyor at an increased speed such that the carrier continues to move forwardly in unison with the load while simultaneously moving laterally out of alignment therewith.

14 Claims, 2 Drawing Figures

CONVEYOR SYSTEM WITH AUTOMATIC LOAD TRANSFER

SUMMARY OF THE INVENTION

This invention relates to a conveyor system and to improvements which enable a load, or article being conveyed, to be automatically transferred between a carrier of an overhead power and free conveyor and a second conveyor arranged parallel to and vertically below the overhead conveyor at a transfer zone.

The loading and unloading of carriers of overhead power and free carriers has conventionally been accomplished either by stopping each carrier, lifting the load and moving the load clear of the carrier; or, by employing a second conveyor on which the load is deposited and by providing each carrier with articulated load engaging portions which can be moved away from the load in order to clear the carrier from the deposited load. These conventional transfer arrangements have the disadvantages of requiring either auxiliary load handling equipment, or specialized carrier construction, together with time and labor for performing the transfer operation.

The present invention provides a simplified and less costly conveyor system which is capable of performing a load transfer operation automatically.

A conveyor system of the invention has an overhead conveyor of the power and free type including a carrier track, a plurality of carriers each including a forward and rearward trolley mounted on the carrier track, a power track positioned adjacent to the carrier track, and driven power means carried by the power tracks for moving the carriers along the carrier track in a forward direction. Each carrier is provided with load supporting structure suspended from the forward and rearward trolleys and having at least one downwardly extending portion which is adapted to be engageable with and disengageable from a load in response to relative vertical movement between the carrier and the load. A second conveyor is arranged in longitudinally parallel relation with and vertically below the overhead conveyor at a transfer zone, is driven in synchronism with the power means of the overhead conveyor, and the overhead and second conveyor are arranged with a vertical spacing which changes through the transfer zone between a greater spacing at which a load is engaged and supported by the load supporting structure of the carrier and a lesser spacing at which the load supporting structure of the carrier is disengaged from the load and the load is supported by the second conveyor. At the lesser spacing, carrier positioning means is operable for moving a carrier between an aligned and a clearance position relative to a load and comprises a pair of carrier track portions which extend obliquely relative to the second conveyor and which are adapted to support the forward and rearward trolleys of each carrier. Transfer power means is associated with one of the parallel track portions for moving each carrier therealong, and is driven in synchronism with the power means of the overhead conveyor and at a speed proportional to the speed of the second conveyor and to the obliquity between the parallel track poritons and the second conveyor so that the relative movement between a carrier on the parallel track portions and a load on the second conveyor is substantially confined to lateral movement.

For example, in the transfer of a load from the overhead to the second conveyor, a carrier moved forwardly through the transfer zone by the overhead conveyor power means, descends from the greater to the lesser spacing thereby depositing the load on the second conveyor and in disengaged relation with the carrier. The carrier and load continue moving forwardly in disengaged relation at the same speed until the carrier is transferred onto the oblique parallel track portions, is engaged by the transfer power means and is driven thereby at a speed such that the carrier continues to move forwardly at the same speed as the load and simultaneously moves laterally out of alignment with the load. The entire load transfer operation is automatically accomplished by synchronized relative forward, vertical and lateral movements between a carrier and the second conveyor.

Other features and advantages of the invention will appear from the following description of the embodiment thereof shown in the accompanying drawing.

DETAILED DESCRIPTION

Figure 1:
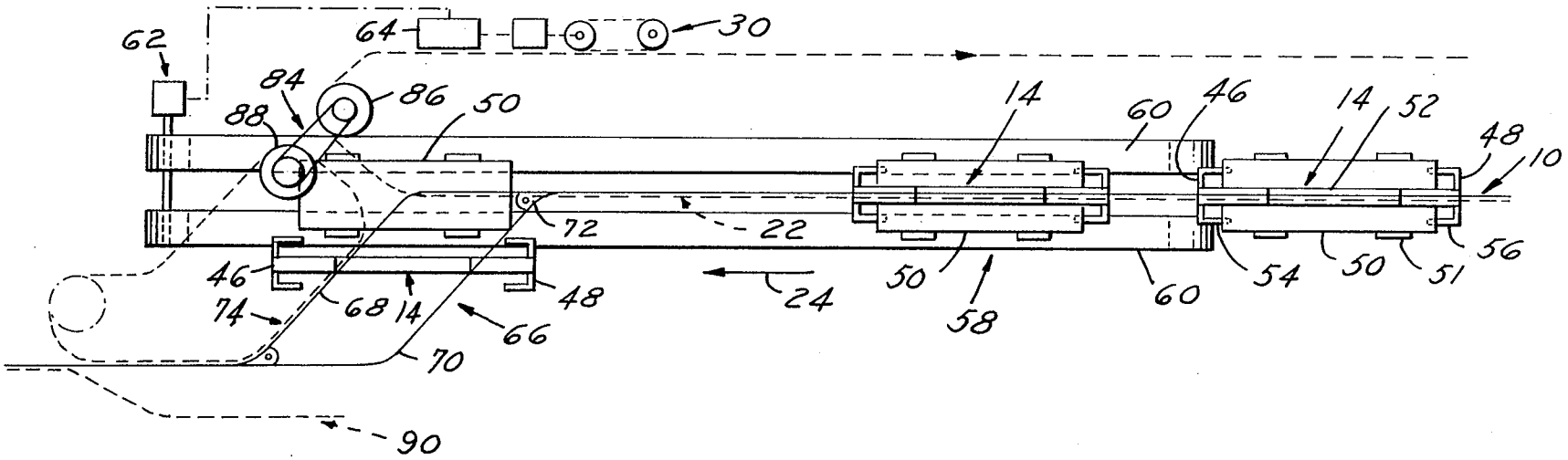
FIG. 1 is a plan view schematically illustrating a conveyor system having a transfer zone arranged in accordance with the invention.
Figure 2:
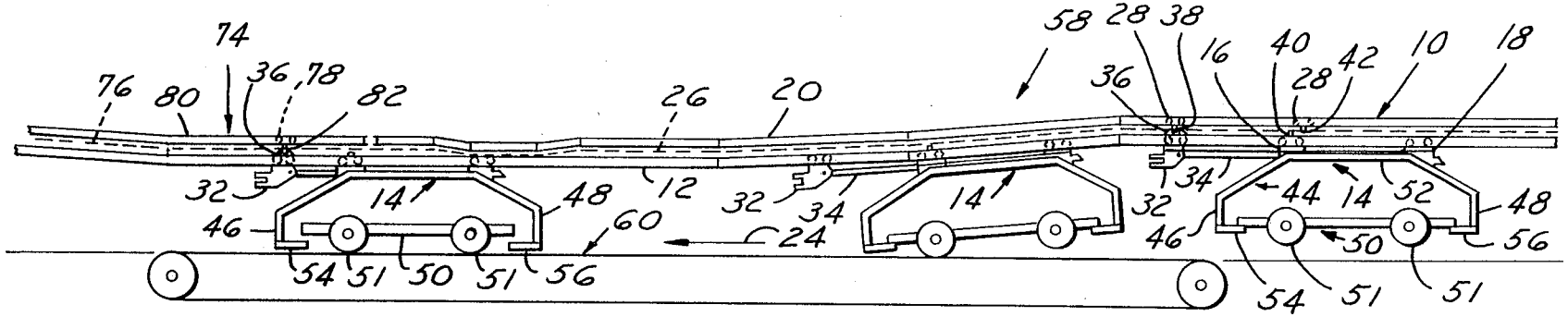
FIG. 2 is a side elevation of the transfer zone of FIG. 1.

The conveyor system shown in FIGS. 1 and 2 includes an overhead power and free conveyor 10 having a carrier track 12 (represented by a solid line in FIG. 1), a plurality of carriers 14 each having a forward trolley 16 and a rearward trolley 18 mounted on the carrier track 12, a power track 20 and driven power means 22 (represented by dash line in FIG. 1) for moving the carriers 14 along the carrier track 12 in a forward direction indicated by the arrow 24. As is conventional in this type of overhead conveyor, the power means 22 consists of an endless chain 26 which is supported by trolleys 28 mounted on the power track 20, is driven by drive unit 30 (FIG. 1), and is provided with longitudinally spaced pushers which project toward the carrier track and are engageable with driving dogs on the carriers 14.

Each carrier 14 in the construction illustrated also includes a driving trolley 32 which is mounted on the carrier track 12 forwardly of the forward trolley 16, is connected to the forward trolley 16 by a tow bar 34, and is provided with a main driving dog 36 normally engageable by a pusher 38. The forward trolley 16 is equipped with a supplementary driving dog 40 of lesser vertical height than the main driving dog 36 and engageable by a second pusher 42 only for advancing the carrier between power means as will be subsequently described. Pushers 38 and 42 are provided on the power means 22 for each carrier at a longitudinal spacing such that the second pusher 42 normally closely trails the supplementary driving dog 40.

As best shown in FIG. 2, each carrier 14 is provided with load supporting structure 44 suspended from the forward trolley 16 and rearward trolley 18 and having a forward portion 46 and a rearward portion 48 extending downwardly and adapted to be engageable with and disengageable from a load 50 in response to relative vertical movement between the carrier 14 and the load 50. The load supporting structure 44 is formed by a framework having an upper portion 52 extending longitudinally of the carrier track 12 and connected to the forward and rearward trolleys 16 and 18. The forward and rearward carrier portions 46 and 48 extend downwardly from the upper portion 52 in fixed relation therewith and include forward and rearward load engaging fixtures 54 and 56 which are rigidly connected to their respective forward and rearward portions 46 and 48 and which project toward each other. This construction provides a relatively simple, unitary load supporting structure for the load 50 illustrated, which includes means (such as wheels 51) for engaging a supporting surface, the means 51 being located between and below the front and rear portions of each load 50.

At a load transfer zone 58 of the conveyor system, a second conveyor 60 is arranged in longitudinally parallel relation with and spaced vertically below the overhead conveyor 10. This second conveyor 60, as illustrated, consists of a pair of endless floor conveyors, driven by a common drive unit 62 in synchronism with the power means 22 of the overhead conveyor 10, and adapted to provide for each load 50 a supporting surface movable in the forward direction 24 at a speed substantially equal to the speed at which the carriers 14 are moved by the power means 22. Substantial speed equality is maintained by a conventional synchronizing control 64 arranged between the drive units 30 and 62.

The vertical spacing between the overhead conveyor 10 and the second conveyor 60 changes through the transfer zone 58 between a greater spacing (shown at the right hand side of FIG. 2) and a lesser spacing. At the greater spacing, a load 50 is engaged and supported by the portions 46, 48 of a carrier 14 (and their respective fixtures 54, 56); at the lesser spacing, the carrier portions 46, 48 are disengaged from the load 50 which is then deposited on the second conveyor 60 and supported thereby.

Carrier positioning means 66, provided in the overhead conveyor 10 at the lesser vertical spacing, is operative to move a carrier 14 forwardly and laterally between an aligned, disengaged position and a clearance position relative to a load 50 deposited by that carrier on the second conveyor 60. This positioning means 66, as shown, comprises a pair of parallel carrier track poritons, consisting of a leading track portion 68 and a trailing track portion 70, which extend obliquely relative to the second conveyor 60. These parallel track portions 68 and 70 are spaced apart along the carrier track 12 by a distance equal to the longitudinal spacing between the forward trolley 16 and the rearward trolley 18 of the carrier 14. The leading track portion 68 is adapted to support the driving trolley 32 and the forward trolley 16 of each carrier 14; the trailing track portion 70 is adapted to support the rearward carrier trolley 18 which is diverted onto the portion 70 by a suitable switch 72.

The positioning means 66 further comprises transfer power means 74 associated with the leading parallel carrier track portion 68 and consisting of an endless chain 76 supported by trolleys 78 from a power track 80 and provided with pushers 82 adapted to engage the main driving dogs 36 of the carrier driving trolleys 32. The transfer power means 74 is driven in synchronism with the power means 22 by driving means 84 consisting of a direct driving connection between a sprocket 86 engaged by the chain 26 and a second sprocket 88 engaged by the transfer chain 76. A speed ratio is established by the driving means 84 such that the speed of the transfer power means 74 is an increased speed proportional to the forward speed of the second conveyor 60 and to the obliquity between the parallel track portions 68 and 70 and the second conveyor 60. The resulting relative movement between a carrier 14, driven on the parallel track portions 68 and 70 by the transfer power means 74, and a load 50, deposited by that carrier on the forwardly moving second conveyor 60 is substantially confined to relative lateral movement.

The transfer of each carrier 14 from propulsion by the power means 22 to propulsion by the transfer power means 74 has not been shown in detail as it is accomplished according to the teachings of U.S. Pat. Nos. 3,314,377 or 3,229,645 to which reference is made. In general, as a pusher 38 on the chain 26 of the power means 22 disengages from the main driving dog 36 of a carrier driving trolley 32 entering the leading parallel carrier track portion 68, positive forward propulsion of the carrier is momentarily lost until the supplementary driving dog 40 on the forward carrier trolley 16 is engaged by a second pusher 42. Such engagement results from the provision of a reduced vertical spacing between the carrier track 12 and the power track 20, and causes the carrier to be advanced into a position in which the main driving dog 36 of its driving trolley 32 is engaged by a pusher 82 on the chain 76 of the transfer power means 74.

Some relative displacement in the forward direction 24 between a carrier 14 and its deposited load 50 will be caused by the pauses in carrier propulsion inherent in this type of transfer arrangement. The extent of such relative displacement should be determined in order to insure that there will be no damaging contact between a carrier and its deposited load. However, damaging contact can be avoided by providing adequate longitudinal clearance between the depending carrier portions 46 and 48 and the load 50 supported thereby, and minimizing the propulsion pauses by properly spacing the pushers 38 and 42 relative to the main and supplementary carrier driving dogs 36 and 40. The proper relative position between the pushers 38 and 42 and the pushers 82 of the transfer chain 76 is maintained by the direct connection between the chains 26 and 76 by the the transfer drive means 84.

Alternative arrangements for transferring a carrier between power chains are known in the art. Any such alternative arrangement can be used in the conveyor system of the invention, provided that excessive relative carrier to load displacement does not result.

In the conveyor system disclosed, a carrier 14, having deposited its load 50 on the second conveyor 60, moves forwardly in unison with that load, is transferred to the transfer power means 74, is moved thereby both in forward unison with and laterally relative to that load, and is then transferred to another power means 90. However, this carrier unloading type of operation can readily be changed to provide a carrier loading operation. By reversing the direction in which all components of the disclosed conveyor system are driven, and by properly placing loads 50 on the conveyor 60 (as by providing that conveyor with load positioning devices, it is apparent that those loads will be automatically transferred from the conveyor 60 to the carriers 14.

It is also possible to employ as the second conveyor 60 a power and free conveyor of the inverted type such as disclosed in U.S. Pat. No. 4,408,540, to which reference is made. Such a conveyor comprises means adapted to provide a support for each load movable in synchronism with and at the speed of the overload conveyor carrier, and loads can be transferred to or from such a conveyor. Basically, the positioning means for relatively moving a load and a carrier between clearance and aligned positions can be provided in either one of the overhead and second conveyors.

Those skilled in the art will also appreciate that the particular carrier construction employed in the practice of the invention will depend upon the configuration of the load. Other load configurations may result in the elimination of such illustrated carrier components as the driving trolley 32 and tow bar 34 by incorporating the main driving dog 30 in the forward carrier trolley 16; or, may require the modification of the load supporting structure 44 of the carrier, for example, by replacing the forward and rearward downwardly extending portions 46 and 48 with a single portion having a transverse load engaging fixture adapted to be moved laterally under a skid-supported load; or may require only a single trolley carrier. Such load-dictated modifications may also require a different form of second conveyor 60; or the elimination of the non-powered parallel carrier track portion 70 in case a single trolley carrier is used; or, an alternative construction for transfering the carrier between the power means 22 and the transfer power means 74. Such alternative constructions, among others, include those disclosed in U.S. Pat. Nos. 3,250,230 and 3,390,642 to which reference is made.

What is claimed is:

1. In a conveyor system having an overhead conveyor including a carrier track, a plurality of carriers each including a forward and a rearward trolley mounted on the carrier track, a power track positioned adjacent to the carrier track, and driven power means carried by the power track for moving the carriers along the carrier track in a forward direction, the improvement wherein:

each carrier is provided with a load supporting structure suspended from said trolleys and having forward and rearward portions extending downwardly and adapted to be engageable with and disengageable from front and rear portions of a load in response to relative vertical movement between said carrier and load portions;

a second conveyor is arranged in longitudinally parallel relation with and is spaced vertically below said overhead conveyor at a load transfer zone, means for driving said second conveyor in synchronism with said power means of said overhead conveyor, said overhead and second conveyors having a vertical spacing which changes through said transfer zone between a greater spacing at which a load is engaged and supported by said forward and rearward portions of a carrier and a lesser spacing at which said forward and rearward portions of a carrier are disengaged from such load and such load is supported by said second conveyor;

and carrier positioning means is operative at said lesser vertical spacing for moving a carrier laterally between an aligned position and a clearance position relative to a load, said carrier positioning means comprising a pair of parallel carrier track portions extending obliquely relative to said second conveyor and adapted to support said forward and rearward load carrying trolleys of each carrier, transfer power means associated with one of said parallel carrier track portions for moving each carrier therealong, and means for driving said transfer power means in synchronism with said power means and at a speed proportional to the speed of said second conveyor and to the obliquity between said parallel track portions and said second conveyor whereby relative movement between a carrier on said parallel track portions and a load on said second conveyor is substantially confined to lateral movement.

2. A conveyor system according to claim 1 wherein said load supporting structure of each carrier comprises a framework having an upper portion extending longitudinally of said carrier track and connected to said forward and rearward trolleys, said forward and rearward carrier portions extending downwardly from said upper portion in fixed relation therewith.

3. A conveyor system according to claim 2 wherein each carrier includes a forward load engaging fixture rigidly connected to said forward carrier portion and a rearward load engaging fixture rigidly connected to said rearward carrier portion, said forward and rearward load engaging fixtures projecting towards each other from their respective carrier portions.

4. A conveyor system according to claim 3 wherein each load includes means for engaging a supporting surface, said engaging means being located between and below said front and rear portions of each load and positioning said front and rear portions thereof in disengaged relation with said forward and rearward load engaging fixtures of a carrier at said lesser vertical spacing between said overhead and second conveyors.

5. A conveyor system according to claim 4 wherein said second conveyor comprises endless means adapted to provide for each load a supporting surface moveable in the forward direction by said second conveyor driving means at a speed substantially equal to the speed at which said carriers are moved along the carrier track by said driven power means.

6. A conveyor system according to claim 5 wherein synchronizing control means is arranged between said driven power means and said second conveyor driving means for maintaining said substantial speed equality between the forward movement of said supporting surface and said carriers.

7. A conveyor system according to claim 6 wherein said means for driving said transfer power means comprises a driving connection from said driven power means to said transfer power means.

8. A conveyor system according to claim 2 wherein each carrier further includes a driving trolley mounted on said carrier track forwardly of said forward trolley and a tow bar connected to said driving and forward trolleys, said driving trolley having a driving dog engagable sequentially by a pusher of said power means and by a pusher of said transfer power means.

9. A conveyor system according to claim 8 wherein said pair of parallel carrier track portions include a leading track portion adapted to support said driving and forward trolleys of each carrier and a trailing track portion, said transfer power means being associated with said leading track portion, and switch means for diverting the rearward trolley of each carrier onto said trailing track portion.

10. A conveyor system according to claim 9 further including means for transferring said driving trolley between said driven power means and said transfer power means.

11. A conveyor system according to claim 1 wherein said second conveyor comprises endless means adapted to provide for each load a supporting surface movable in the forward direction by said second conveyor driving means at a speed substantially equal to the speed at which said carriers are moved along the carrier track by said driven power means.

12. A conveyor system having an overhead conveyor including a carrier track, a plurality of carriers each including at least one trolley mounted on the carrier track, a power track positioned adjacent to the carrier track, and driven power means carrier by the power track for moving the carriers along the carrier track in a forward direction, the improvement wherein:

each carrier is provided with a load supporting structure suspended from said trolley and having at least one downwardly extending portion adapted to be engageable with and disengageable from a load in response to relative vertical movement between the carrier and the load;

a second conveyor is arranged in longitudinally parallel relation with and is spaced vertically below said overhead conveyor at a load transfer zone, means for driving said second conveyor in synchronism with said power means of said overhead conveyor, said overhead and second conveyors having a vertical spacing which changes through said transfer zone between a greater spacing at which a load is engaged and supported by said downwardly extending portion of a carrier and a lesser spacing at which said downwardly extending portion of a carrier is disengaged from such load and such load is supported by said second conveyor; and carrier positioning means is operative at said lesser vertical spacing for moving a carrier laterally between a clearance position and an aligned position relative to a load, said carrier positioning means comprising at least one carrier track portion extending obliquely relative to said second conveyor and adapted to support said trolley of each carrier, transfer power means associated with said obliquely extending carrier track portion for moving each carrier therealong, and means for driving said transfer power means in synchronism with said power means and at a speed proportional to the speed of said second conveyor and to the obliquity between said track portion and said second conveyor whereby relative movement between a carrier on said track portion and a load on said second conveyor is substantially confined to lateral movement.

13. A conveyor system having an overhead conveyor, and a second conveyor, portions of said overhead and second conveyors being arranged in longitudinally parallel vertically spaced relationships at a load transfer zone, the improvement wherein:

said overhead conveyor includes a carrier track, a plurality of carriers mounted on the carrier track, each carrier being provided with a load supporting structure having at least one downwardly extending portion adapted to be engageable with and disengageable from a load in respone to relative vertical movement between the carrier and the load, and driven power means for moving the carriers along the power track in a forward direction;

said second conveyor comprises means adapted to provide a support for each load, and means for driving said second conveyor in synchronism with said overhead conveyor at a speed substantially equal to the speed at which said carriers are moved along the carrier track by said driven power means, said overhead and second conveyors having a vertical spacing which changes through said transfer zone between a greater spacing at which a load is engaged and supported by said downwardly extending portion of a carrier and a lesser spacing at which said downwardly extending portion of a carrier is disengaged from such load and such load is supported by said second conveyor; and positioning means is provided at said lesser spacing in one of said overhead and second conveyors for relatively laterally moving a load and a carrier between a clearance position and an aligned position, said positioning means comprising a transfer portion of said one conveyor extending obliquely to said longitudinally parallel portions, transfer power means associated with said obliquely extending transfer portion for moving each load therealong, and means for synchronously driving said transfer power means and at a speed proportional to the speed of the other of said overhead and second conveyors and to the obliquity of said transfer portion whereby a load on said transfer portion is moved in the forward direction at a speed substantially equal to the speed of the other of said overhead and second conveyors.

14. A conveyor system according to claim 13 wherein said one conveyor in which said positioning means is provided in a power and free conveyor.

* * * * *